US005921132A

United States Patent [19]

Froehlich

[11] Patent Number: 5,921,132

[45] Date of Patent: Jul. 13, 1999

[54] PORTABLE TUBE BENDER

[76] Inventor: Anthony E. Froehlich, 5663 Davenport St., Coeur d'Alene, Id. 83814

[21] Appl. No.: 09/096,886

[22] Filed: Jun. 12, 1998

[51] Int. Cl.[6] ..... B21D 7/08

[52] U.S. Cl. ..... 72/389.8; 72/389.6

[58] Field of Search ..... 72/389.1, 389.2, 72/389.6, 389.8

[56] References Cited

U.S. PATENT DOCUMENTS

| | | | |
|---|---|---|---|
| 3,042,099 | 7/1962 | Neely | 153/2 |
| 3,724,256 | 4/1973 | Kroetch | 72/332 |
| 3,964,289 | 6/1976 | Williamson, Jr. | 72/381 |
| 4,782,686 | 11/1988 | Carson, Jr. | 72/389.7 |
| 4,790,168 | 12/1988 | Vonthien | 72/389.6 |

FOREIGN PATENT DOCUMENTS

| | | | |
|---|---|---|---|
| 1003969 | 3/1952 | France | 72/389.6 |
| 1024321 | 3/1953 | France | 72/389.6 |

*Primary Examiner*—David B. Jones
*Attorney, Agent, or Firm*—Thomas G. Walsh; Isaac Angres

[57] ABSTRACT

The present invention relates to a tube bending apparatus which has a portable size and is easy to handle, with less cost of bending. The bending apparatus comprises a base plate having an elongated frame mounted on it. The frame includes a top support plate and a bottom support plate parallel to each other, a square support tube and four support bars. A pair of lateral rollers are mounted on each side of the two support plates of the frame and a power means, such as a hydraulic or mechanical ram, is mounted to the support tube to provide a reciprocating movement. A mandrel is engaged to one end of the ram and also to a bending die member which has a semi-circular configuration on its front face and grooves extending on the semi-circular face for relieving stress during the bending operation. The ram is loaded with one or two springs for the convenience of changing and accommodating the bending die members when reloading different sizes of tubing. The bending apparatus can bend square tube smoothly and uniformly with minimized collapse or distortion and in one step.

16 Claims, 2 Drawing Sheets

PORTABLE TUBE BENDER

BACKGROUND OF THE INVENTION

The present invention relates to a tube bender, and more specifically to a portable tube bender for bending square tubes, which is lightweight, less costly and easy to handle. More in particular, the tube bender of the instant invention is most useful for bending square tubes.

Apparatus for cold bending tubes, pipes or rods are well known in the art. Conventional apparatus generally comprise an elongated frame with power means, such as a reciprocating hydraulic ram mounted lengthwise on a frame, a forming die or bending shoe having a semi-circular configuration mounted on the end of the ram, and a pair of workpieces holding rollers mounted in fixed relation to the forming die. Each roller has a receiving channel concave in cross-section for holding the tubular workpiece. The tubular workpiece is held against the rollers and the power means pushes against the center portion of the workpiece between the rollers to form a bend in the workpiece. For bending square tubes, many conventional bending apparatus utilize a two-step method to complete a tube bending. The first step is to indent or crimp side walls of a tube and the second step is to bend the tube.

DESCRIPTION OF THE PRIOR ART

U.S. Pat. No. 3,042,099 to Neely, discloses a method for square tube bending. The first step of the '099 patent involves longitudinal indenting of the side walls of a tube with oppositely arranged two die members and the second step involves bending the indented tube with another different die member.

U.S. Pat. No. 3,964,289 to Williamson, Jr., teaches a rectangular metal-tubing bender and a method of bending a rectangular tube. The bender includes a squeezing arrangement which has two jaws for forming depressions on opposite sides of a square tube and a forming arrangement for bending the tube into a closed corner about the depressions therein.

U.S. Pat. No. 3,724,256, to Kroetch, describes a combination of cutting and bending machine for cutting and bending a square tube, wherein the bending is accomplished by utilizing a sliding mandrel assembly. A tube is caused to be bent around a mandrel in the mandrel assembly and a small rim is utilized on the mandrel inside its slot to fold a side of the tube during bending.

The conventional apparatus, such as those mentioned above, usually have large size and complicated structure, which limit their use in many occasions. More in particular, in the two-step tube bending method, the structure for the bender is even more complicated and it takes longer time to complete the bending. Another problem with the conventional apparatus is that it is difficult to change the die or the bending shoe when it has to process a different size of tube. Also, with the conventional bending apparatus, collapse or distortion happens when the pressure is increased on tubes being bent.

Therefore, it is desirable to provide a bending apparatus which is not only small, compact and lightweight, but also easy to handle with less collapse or distortion.

SUMMARY OF THE INVENTION

It is an object of the invention to provide a tube bending apparatus which is portable in size and is easy to handle, with less cost of bending.

Still another object of the invention is to provide a square tube bending apparatus which is portable in size and is easy to handle, with less cost of bending.

Another object of the invention is to provide a tube bending apparatus for bending square tube smoothly and uniformly with minimum collapse or distortion.

A further object of the present invention is to provide a method of bending a square tube in one step.

The foregoing and other objects of the present invention are achieved by a tube bending apparatus which comprises a base plate having an elongated frame mounted on it. The frame includes a top support plate and a bottom support plate parallel to each other, a support tube and four support bars. The four support bars connect the two support plates and the support tube together. A pair of lateral rollers are mounted on each side of the two support plates of the frame and a power means, such as a hydraulic or mechanical ram, is mounted at a mounting end thereof to the support tube to provide a reciprocating movement. A mandrel is engaged to another end of the ram opposite the mounting end. The mandrel also engages a bending die member which has a semi-circular configuration on its front face and grooves extending on the semi-circular face for relieving stress during the bending operation. The ram is loaded with one or two spring assemblies for the convenience of changing and accommodating the bending die members being used for different sizes of tubing. There is a wire gauge attached on the top support plate to provide an accurate measurement of the bending.

With the tube bending apparatus provided by the present invention, the bending operation can be very easy and convenient. There is no need to crimp or indent the square tube prior to or during the bending operation. The whole bending process can be completed in one step.

With the special configuration of the bending die member of the present invention, it allows a smooth and successful bending up to 180 degree as the grooves on the die member contribute to stress relief. The spring-loaded ram makes it easy to change different die members as needed.

Other objectives and advantages of the present invention will be apparent in the following detailed description, claims and accompanying drawings.

DETAILED DESCRIPTION OF THE INVENTION

With references to the Figures, the invention will be described in terms of the best mode and preferred embodiment.

Figure 1:
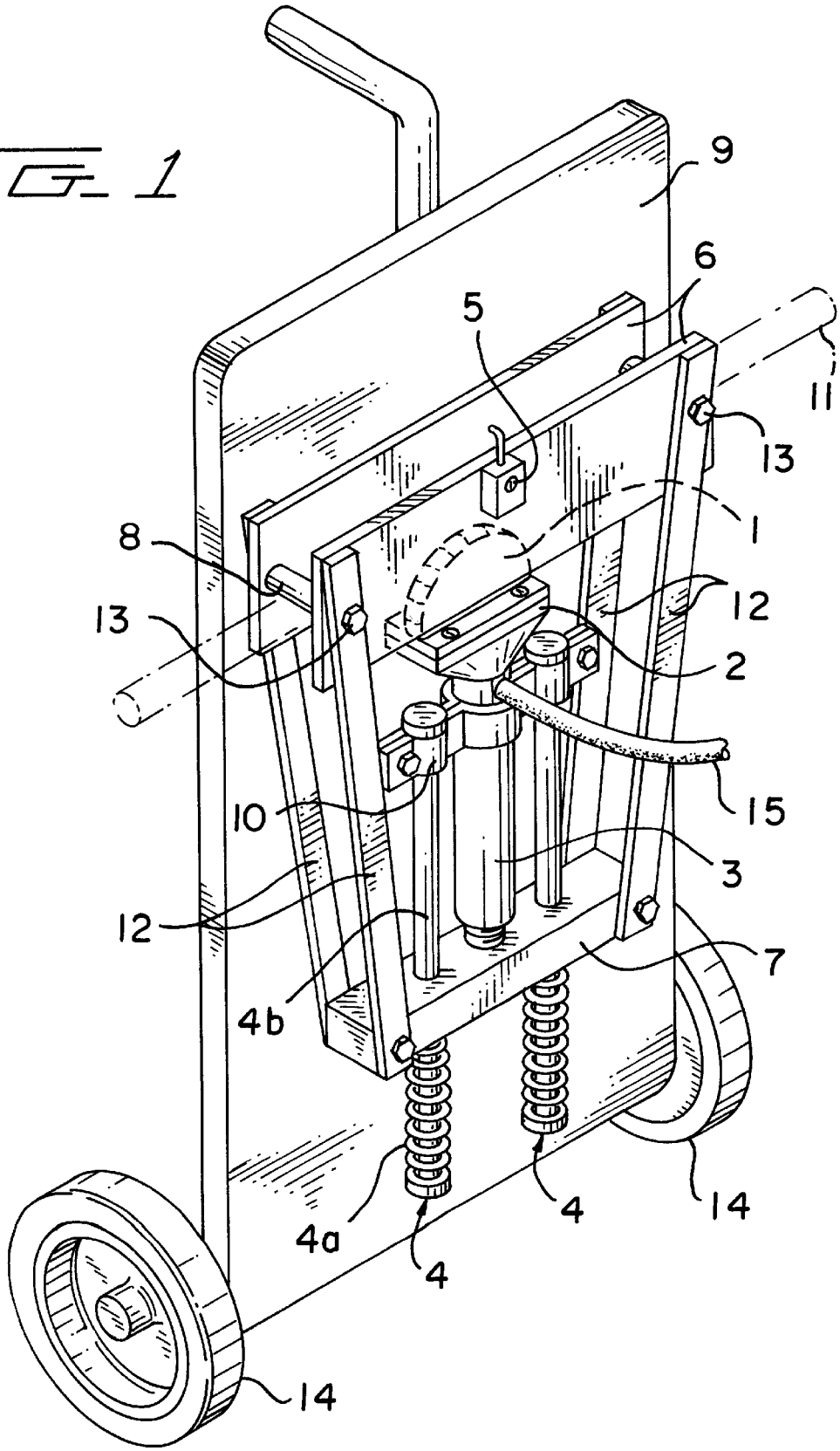
FIG. 1 is a perspective view of a bending apparatus embodying the novel features of the present invention.
Figure 3:
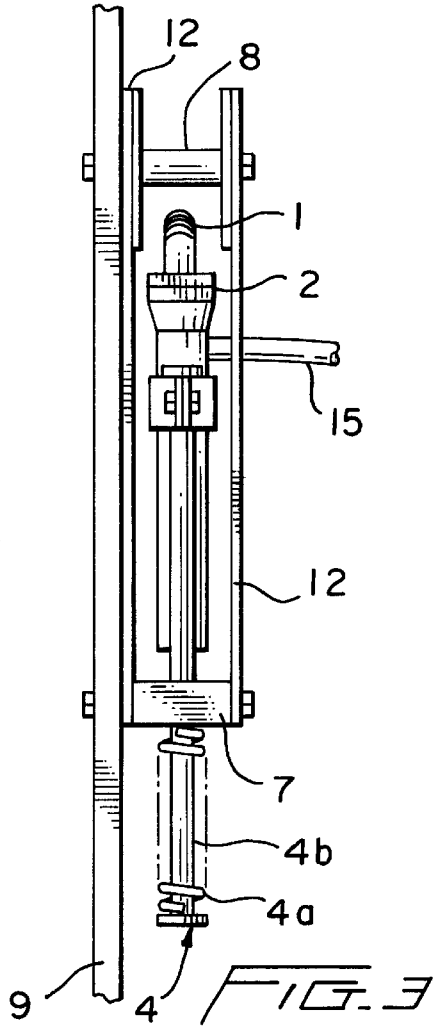
FIG. 3 is a side elevation of the bending apparatus as shown in FIG. 1.
Figure 2:
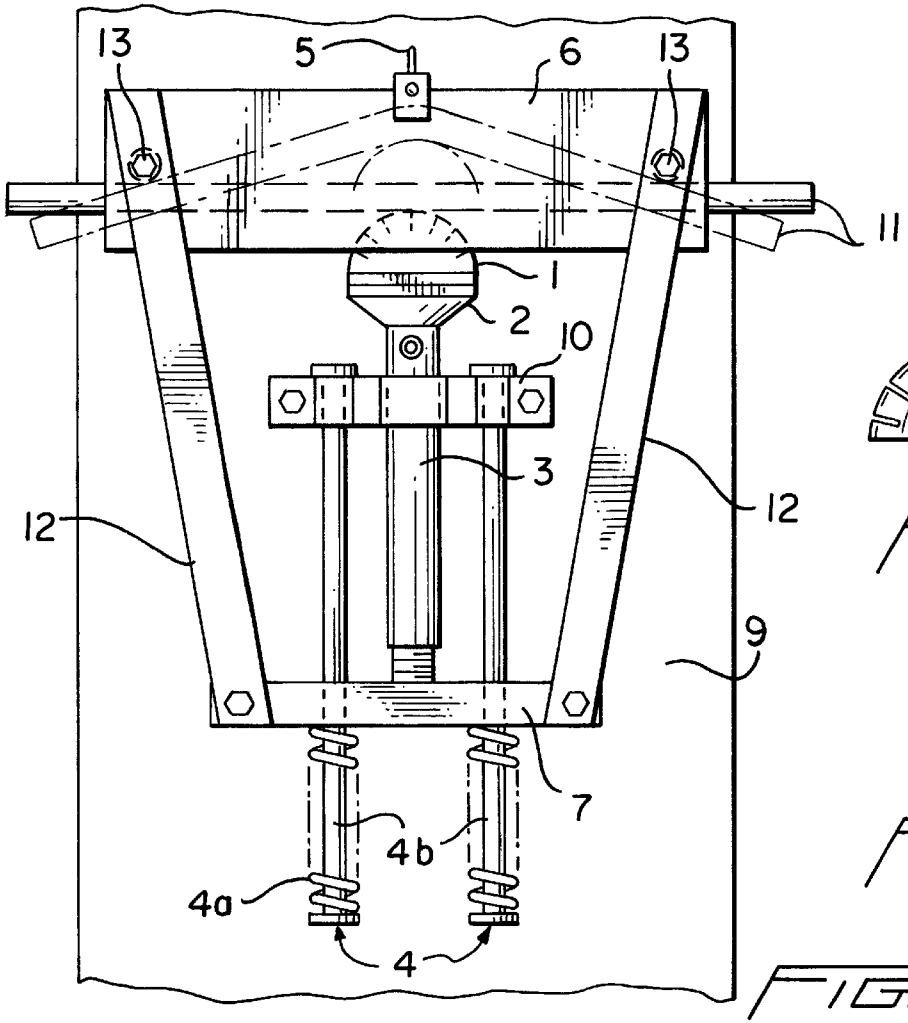
FIG. 2 is a front elevation of the bending apparatus as shown in FIG. 1.

In FIGS. 1, 2 and 3, a bending die member 1 may have a pin on the face of the center line of the radius, which gives a point to index from which a layout work could be done on the tube to be bent. The die member 1 is mounted to a mandrel 2 which reciprocates along the axis through a hydraulic ram 3. The hydraulic ram 3 engages with a return force means comprised of two spring assemblies 4 and a spring holder 10, which are mounted to a square tube support 7. Each spring assembly 4 is comprised of a spring 4*a* and a rod 4*b*. The two spring assemblies make it easy to reset for another tubing work when reloading the machine. The spring holder 10 keeps the hydraulic ram, and consequently the bending die member, retracted so a tube to be bent can be reloaded and the bending die member can be easily changed as desired. A pair of two parallel roll bars 8 rotatably go through a pair of support plates 6, both of which are supported by four support bars 12. The four support bars 12, the two support plates 6 and the square support tube 7 form a frame which can be attached to a base plate 9 by any mechanical means. The two rollers can be adjusted to receive tubing from ¾ inch to 2 inches wide. With finger or hand tightening, an operator can take care of the horizontal adjustment. Vertical adjustment within a range of 3 inches can be adjusted from the ram end. Measurements for the rollers are ¾ inch in diameter by 4½ inches long or ⅝ inch in diameter by 4 inches long. The rollers also have pivot attachments 13 that are drilled off center and give more tube support over the rollers. A tubular workpiece 11 is held between the lateral rollers 8 and the bending die member 1. The mandrel 2 on the hydraulic ram 3 extends outward to advance the bending die member 1 against the workpiece 11. As the die member 1 advances and the workpiece begins to bend, the workpiece may be bent up to a full 180 degree. The two support plates 6 hold the outer walls of the workpiece in line and also help to reduce collapse. A wire gauge 5 with a set of screws (not shown) is connected to the top support plate 6. The wire gauge can be set at various depths with the screws according to the requirements of angle or bend given to the workpiece. The wire gauge also serves as an indicator to enable the operator of the bending machine to obtain good readings from either side of the frame. Number 15 indicates a pipe line connected to a hydraulic pump.

Figure 4:
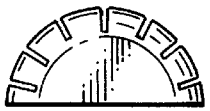
FIG. 4 is a front elevation of a bending die used in the present invention.
Figure 5:
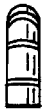
FIG. 5 is a side elevation of the bending die.

FIGS. 4 and 5 depict a die member according to the present invention. The die has a number of grooves on its surface, which is designed to relieve stress so as to take less pressure on the tube being bent. For a die with a radius of 3½ inches and a thickness of about 1 inch, each groove can be about 0.0312 inch deep or larger. Each groove can form an angle from 20 to 120 degrees. As the mandrel 2 moves forward along an axis against the workpiece 11, pressure on the workpiece gradually builds up, which easily leads to collapse of the workpiece. With the special curvature of the present die member, the pressure on the workpiece will be greatly reduced compared with conventional die members, and therefore much less collapse occurs with the present bending device. Besides all the advantages mentioned above, there is no need to bend the workpiece by two steps, such as to crimp or impress sides of the workpiece prior to bending it, as most conventional bending machines require. Only one step is needed to complete the bending.

The bending apparatus of the present invention can be also equipped with wheels and telescoping handle for easy moving and handling. Number 14 shows a wheel attachment for the bending apparatus.

The bending apparatus of the present invention may have a size in the range of 20 to 28 inches by 15 to 21 inches by 4 to 8 inches. With attached wheels and telescoping handle, as an example, an approximate size of the bending apparatus is 24 inches by 18 inches by 6 inches, with an approximate weight of 100 lbs. It can bend square tube sizes from ¾ inch by ¾ inch to 2 inches by 2 inches with a bending die of 3½ inches in radius.

While the invention has been described with reference to a preferred embodiment, it will be understood by those skilled in the art that various changes in form and detail may be made therein without departing from the spirit and scope of the invention.

What is claimed is:

1. A tube bending apparatus for bending tubes comprising:

(a) a base plate having an elongated frame mounted on it; said frame comprising a top support plate and a bottom support plate parallel to each other, a support tube, and four support bars, the four support bars connecting said two support plates and said support tube together;

(b) a pair of lateral rollers mounted in between said two support plates of the frame;

(c) power means having a mounting end mounted to the support tube to provide a reciprocating movement lengthwise along the frame;

(d) a mandrel engaged on one side to an end of said power means opposite said mounting end;

(e) a bending die member engaged to another side of the mandrel opposite said one side and having a semi-circular configuration on its front face and grooves extending on the front face for relieving stress during a bending operation; and (f) a return force means engaging with said support tube and said power means for facilitating retraction of said bending die member after a tube has been bent.

2. A tube bending apparatus according to claim 1, wherein the power means is a hydraulic ram.

3. A tube bending apparatus according to claim 2 wherein said return force means comprises a) a pair of spring assemblies disposed in a plane perpendicular to and passing through said support tube such that each spring assembly of said pair extends in opposing lateral relationship to said hydraulic ram, and b) a spring holder engaging each of said spring assemblies and an outer portion of said hydraulic ram for effecting concerted reciprocating movement between said spring assemblies and said hydraulic ram.

4. A tube bending apparatus according to claim 1, wherein the bending die member is 1 inch thick and 3½ inches in radius.

5. A tube bending apparatus according to claim 1, wherein each groove on the bending die member is at least 0.0312 inch deep.

6. A tube bending apparatus according to claim 1, which has a size in a range of 20 to 28 inches by 15 to 21 inches by 4 to 8 inches.

7. A tube bending apparatus according to claim 1, which further has a gauge mounted on the frame for measuring and indicating bending angle.

8. A tube bending apparatus according to claim 1, which is further equipped with wheels and a handle for moving and handling.

9. A portable tube bending apparatus for bending square tubes comprising:

(a) a base plate having an elongated frame mounted on it; said frame comprising a top support plate and a bottom support plate parallel to each other, a support tube, and four support bars, the four support bars connecting said two support plates and said support tube together;

(b) a pair of lateral rollers mounted in between said two support plates of the frame;

(c) power means having a mounting end mounted to the support tube to provide a reciprocating movement lengthwise along the frame;

(d) a mandrel engaged on one side to an end of said power means opposite said mounting end;

(e) a bending die member engaged to another side of the mandrel opposite said one side and having a semi-circular configuration on its front face and grooves extending on the front face for relieving stress during a bending operation; and (f) a return force means engaging with said support tube and said power means for facilitating retraction of said bending die member after a tube has been bent.

10. A tube bending apparatus according to claim 9, wherein the power means is a hydraulic ram.

11. A tube bending apparatus according to claim 9, wherein the bending die member is 1 inch thick and 3½ inches in radius.

12. A tube bending apparatus according to claim 9, wherein each groove on the bending die member is at least 0.0312 inch deep.

13. A tube bending apparatus according to claim 9, which has a size in a range of 20 to 28 inches by 15 to 21 inches by 4 to 8 inches.

14. A tube bending apparatus according to claim 9, which further has a gauge amounted on the frame for measuring and indicating bending angle.

15. A tube bending apparatus according to claim 9, which is further equipped with wheels and a handle for moving and handling.

16. A tube bending apparatus according to claim 10 wherein said return force means comprises a) a pair of spring assemblies disposed in a plane perpendicular to and passing through said support tube such that each spring assembly of said pair extends in opposing lateral relationship to said hydraulic ram, and b) a spring holder engaging each of said spring assemblies and an outer portion of said hydraulic ram for effecting concerted reciprocating movement between said spring assemblies and said hydraulic ram.

* * * * *